US008146551B2

(12) United States Patent
Pluta

(10) Patent No.: US 8,146,551 B2
(45) Date of Patent: Apr. 3, 2012

(54) CONCENTRIC CAM WITH PHASER

(75) Inventor: Christopher J. Pluta, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 347 days.

(21) Appl. No.: 12/663,555

(22) PCT Filed: Jun. 6, 2008

(86) PCT No.: PCT/US2008/066030

§ 371 (c)(1),
(2), (4) Date: Dec. 8, 2009

(87) PCT Pub. No.: WO2008/157076

PCT Pub. Date: Dec. 24, 2008

(65) Prior Publication Data

US 2010/0186698 A1 Jul. 29, 2010

Related U.S. Application Data

(60) Provisional application No. 60/944,806, filed on Jun. 19, 2007.

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31

See application file for complete search history.

(56) References Cited

U.S. PATENT DOCUMENTS

| | | | | |
|---|---|---|---|---|
| 5,107,804 | A | 4/1992 | Becker et al. | |
| 5,172,659 | A | 12/1992 | Butterfield | |
| 5,235,939 | A | 8/1993 | Levin et al. | |
| 5,417,186 | A | 5/1995 | Elrod et al. | |
| 5,542,383 | A * | 8/1996 | Clarke et al. | 123/90.17 |
| 6,725,817 | B2 | 4/2004 | Methley et al. | |
| 6,745,732 | B2 | 6/2004 | Ekdahl et al. | |
| 6,763,791 | B2 | 7/2004 | Gardner et al. | |
| 6,883,481 | B2 | 4/2005 | Gardner et al. | |
| 7,036,473 | B1 | 5/2006 | Goracy | |
| 7,255,077 | B2 | 8/2007 | Simpson et al. | |
| 2005/0279302 | A1 | 12/2005 | Lancefield et al. | |
| 2006/0207529 | A1 | 9/2006 | Lawrence et al. | |
| 2006/0207538 | A1 | 9/2006 | Lancefield et al. | |
| 2008/0135004 | A1 | 6/2008 | Simpson et al. | |

FOREIGN PATENT DOCUMENTS

| | | |
|---|---|---|
| EP | 1614867 | 1/2006 |
| GB | 2327482 | 1/1999 |
| JP | 2004108370 | 4/2004 |
| WO | 2006000832 | 1/2006 |
| WO | 2006050686 | 5/2006 |

* cited by examiner

*Primary Examiner* — Zelalem Eshete
(74) *Attorney, Agent, or Firm* — Brown & Michaels, PC

(57) ABSTRACT

An assembly for an engine comprising at least one phaser and a camshaft assembly. The camshaft assembly has an outer camshaft piece and an inner camshaft piece. The outer camshaft piece includes an outside cam integrally attached to the housing of the phaser through a middle portion. The outer camshaft piece also defines a hollow extending a length. The inner camshaft piece includes an inner cam adjacent to the outer cam. A tube portion extends from a first side of the inner cam and is received by the hollow of the outer camshaft piece, connecting the inner cam to the rotor of the phaser. A shaft portion extends to an end portion from the other side of the outer cam. A passage, connected to an inlet line is present within the inner camshaft piece, directing fluid to the control valve of the phaser.

23 Claims, 9 Drawing Sheets

SECTION B–B

SECTION B-B

CONCENTRIC CAM WITH PHASER

REFERENCE TO RELATED APPLICATIONS

This application claims one or more inventions which were disclosed in Provisional Application No. 60/944,806, filed Jun. 19, 2007, entitled "CONCENTRI CAM WITH PHASER". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable cam timing systems. More particularly, the invention pertains to a variable cam timing system including a phaser with concentric cams.

2. Description of Related Art

US Published Application No. US 2005/0279302 discloses a vane-type phaser driven by a crankshaft that drives the inner shaft and the outer tube of a first single cam phaser camshaft, which is coupled for rotation with the inner shaft and the outer tube of a second single cam phaser camshaft by drive links. The drive links are meshing gearwheels. The phaser may alter both the inner shafts and outer tubes of both camshafts or individual single vane-type phasers may each transmit torque to the first and second camshafts.

The first and second camshafts each have cams formed directly on the two inner shafts and other cams formed on the two outer tubes. Cams that rotate with the outer tubes have collars coupled to the outer tube by heat shrinking and cams that rotate with the inner shaft are loose fit on the outer tube and are connected to the inner shaft by pins that pass through the circumferentially elongated slots in the outer tube.

U.S. Pat. No. 7,036,473 discloses an adjustable camshaft with an elongated shaft which includes multiple shaft sections carrying intake and/or exhaust cam lobes. The first shaft section includes a shaft extending therefrom, and the second shaft section includes a hollow sleeve extending therefrom to accept the shaft therein to rotatably associate the first shaft section with the second shaft section. With the first and second shaft sections rotatably associated with each other, the sections may be selectively rotated relative to each other in order to adjust a displacement angle between the cam lobes to alter the intake and exhaust timing. The elongated shaft is attached to a drive/timing gear assembly which includes a gear and hub. An inner shaft may extend through the elongated shaft for attachment to the engine block. The cams may be locked to the shaft and relative to one another by a locking nut or a pin.

SUMMARY OF THE INVENTION

An assembly for an engine comprising at least one phaser and a camshaft assembly.

The phaser has a housing, a rotor and a control valve. The housing has an outer circumference for accepting drive force. The rotor is coaxially located within the housing. Both the housing and the rotor define at least one vane that separates a chamber in the housing into advance and retard chambers. The vane is capable of rotation to shift the relative angular position of the housing and the rotor. The control valve is received within a bore in the rotor for directing fluid to the chambers.

The camshaft assembly has an outer camshaft piece and an inner camshaft piece. The outer camshaft piece includes an outside cam integrally attached to the housing of the phaser through a middle portion. The outer camshaft piece also defines a hollow extending a length. The inner camshaft piece includes an inner cam adjacent to the outer cam. A tube portion extends from a first side of the inner cam and is received by the hollow of the outer camshaft piece, connecting the inner cam to the rotor of the phaser. A shaft portion extends to an end portion from the other side of the outer cam. A passage, connected to an inlet line is present within the inner camshaft piece, directing fluid to the control valve of the phaser.

When the rotor of the phaser moves, the inner cam is phased relative to the outer cam, allowing duration of a valve event to be increased or decreased.

In another embodiment, two phasers are used with the camshaft assembly.

The phasers may be cam torque actuated, oil pressure actuated, torsion assist, or hybrid.

DETAILED DESCRIPTION OF THE INVENTION

Figure 1:
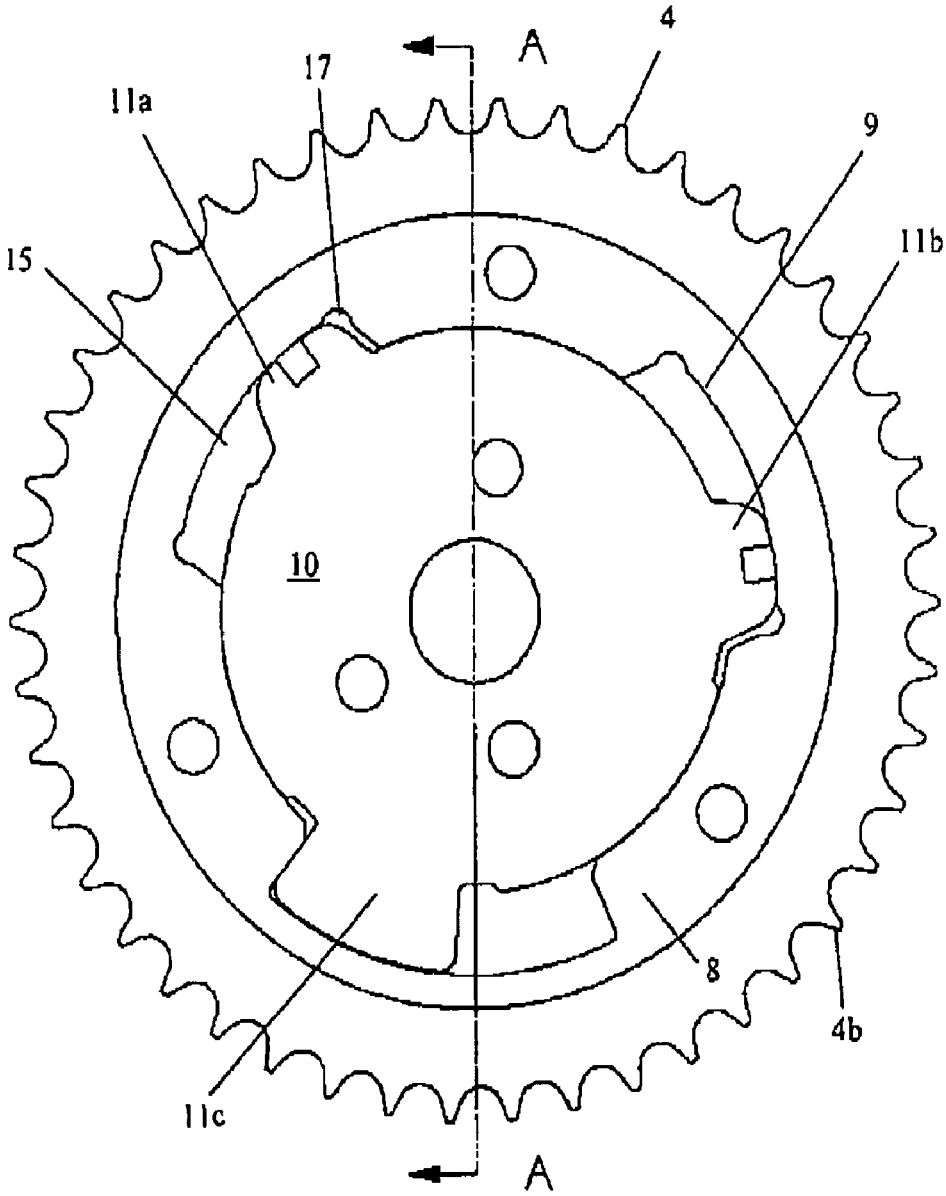
FIG. 1 shows a schematic of a variable cam timing phaser with concentric cams on one camshaft.

Internal combustion engines have employed various mechanisms to vary the angle between the camshaft and the crankshaft for improved engine performance or reduced emissions. The majority of these variable camshaft timing (VCT) mechanism use one or more "vane phasers" on the engine camshaft 26 (or camshafts, in a multiple-camshaft engine). In most cases, the phasers 25 have a rotor 10 with one or more vanes, mounted to the end of the camshaft 26, surrounded by a housing 8 with the vane chambers 9 into which the vanes 11*a* 11*b*, 11*c* fit, dividing the vane chambers 9 into advance and retard chambers 15, 17. It is possible to have the vanes 11 mounted to the housing 8, and the chambers 9 in the rotor 10, as well. The a portion of the housing's 8 outer circumference 4*c* forms the sprocket, pulley or gear accepting drive force through a chain, belt, or gears, usually from the crankshaft, or possible from another camshaft in a multiple-cam engine.

Figure 2:
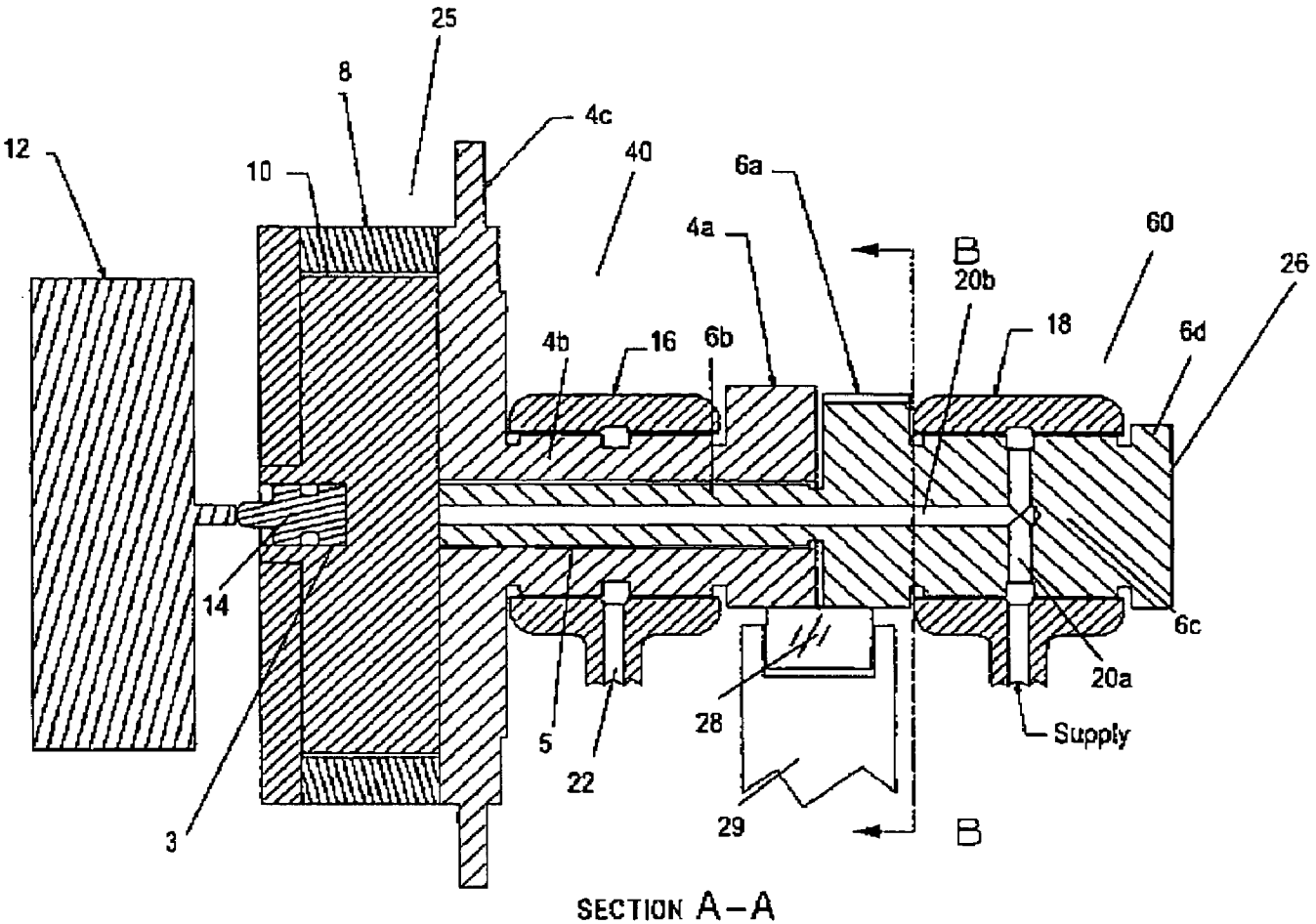
FIG. 2 shows a section of FIG. 1 along line A-A.
Figure 3:
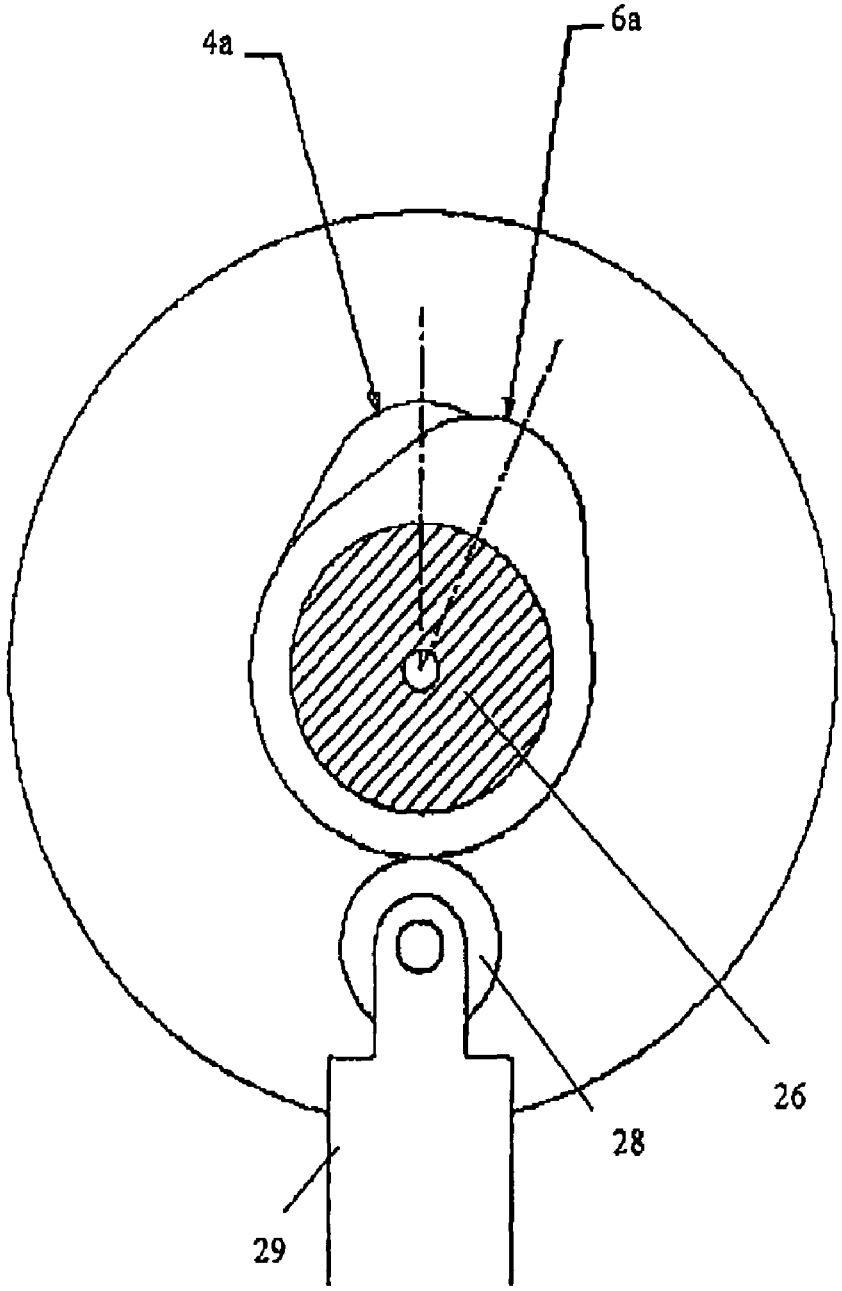
FIG. 3 shows a section of FIG. 2 along line B-B.

Referring to FIGS. 1 through 3, an outside cam 4*a* is integrally attached to the portion 4*c* of housing 8 forming the outer circumference of the housing for accepting drive force through a middle portion 4*b*, forming a first camshaft piece or outer camshaft piece 40. The first camshaft portion or inner camshaft portion 40 includes portion 4*c* forming the outer circumference of the housing for accepting drive force, a middle portion 4*b*, and the outside cam 4*a*. The middle portion 4*b* is surrounded by a first bearing 16. A central hollow 5 extends the entire length of the first camshaft piece 40, in other words, through the outside cam 4*a*, the middle portion 4*b*, and through the portion 4*c* of the housing 8 forming the outer circumference for accepting drive force. The portion 4*c* for accepting drive force seals the end of the phaser 25 and is fixedly attached to the housing 8.

Adjacent to the outside cam 4*a* is an inner cam 6*a*. By having the inside and outside cams 4*a*, 6*a* inline next to each other, the roller 28 of the lifter 29 is able to ride on both lobes of the cams 4*a*, 6*a* at the same time. The inner cam 6*a* is integral with a tube 6*b* on one end that is received within the hollow 5 of the first camshaft piece 40 and is connected to the rotor 10 of the phaser 25 coaxially located within the housing 8. The rotor 10 has a plurality of vanes 11*a*, 11*b*, 11*c* that separate chambers 9 formed between the housing 8 and the rotor 10 into advance chambers and retard chambers 15, 17. Opposite the inner tube portion 6*b*, on the other side of the inner cam 6*a* is a shaft portion 6*c* with an end piece 6*d* larger than the diameter of the first camshaft piece 40 and the inner tube portion 6*b* and shaft portion 6*c*. The end piece 6*d* on the shaft portion 6*c* prevents the second camshaft piece or inner camshaft piece 60 comprised of the inner cam, 6*a*, the inner tube portion 6*b*, shaft portion 6*c*, and the end piece 6*d*, from dislodging from the assembly. The shaft portion 6*c*, not including the end piece 6*d* is surrounded by a second bearing 18. A passage 20*b* is present along the length of the second camshaft piece or inner camshaft piece 60 to supply fluid from the inlet line 20*a* to the phaser. Line 22 supplies oil to feed the cam bearing. The passage 20*b* provides fluid to the advance and retard chambers 15, 17 through a control valve 14 with in a bore 3 in the rotor 10. The control valve 14 controls the flow of fluid to the advance and retard chambers 15, 17 and the position of the rotor 10 relative to the housing 8. The position of the control valve 14 is influenced by an actuator 12. The actuator shown in FIG. 2 may be a variable force solenoid, a motor, or an on/off solenoid.

As the rotor 10 moves, the inner cam 6*a* is phased relative to the fixed outer cam 4*a*, allowing duration of the valve event to be increased or decreased. By varying the duration of the valve event, the valve opening or closing ramps are varied. Since the cam bearings 16, 18 in the head are used to support the inner camshaft piece 40 and the outer camshaft piece 60, no bearings are required in the outer camshaft piece 60 to support the inner camshaft piece 40. By not having any bearings internal to the outer cam 4*a*, the base circle runout is dictated by the cam bearing clearance in the head.

Figure 4:
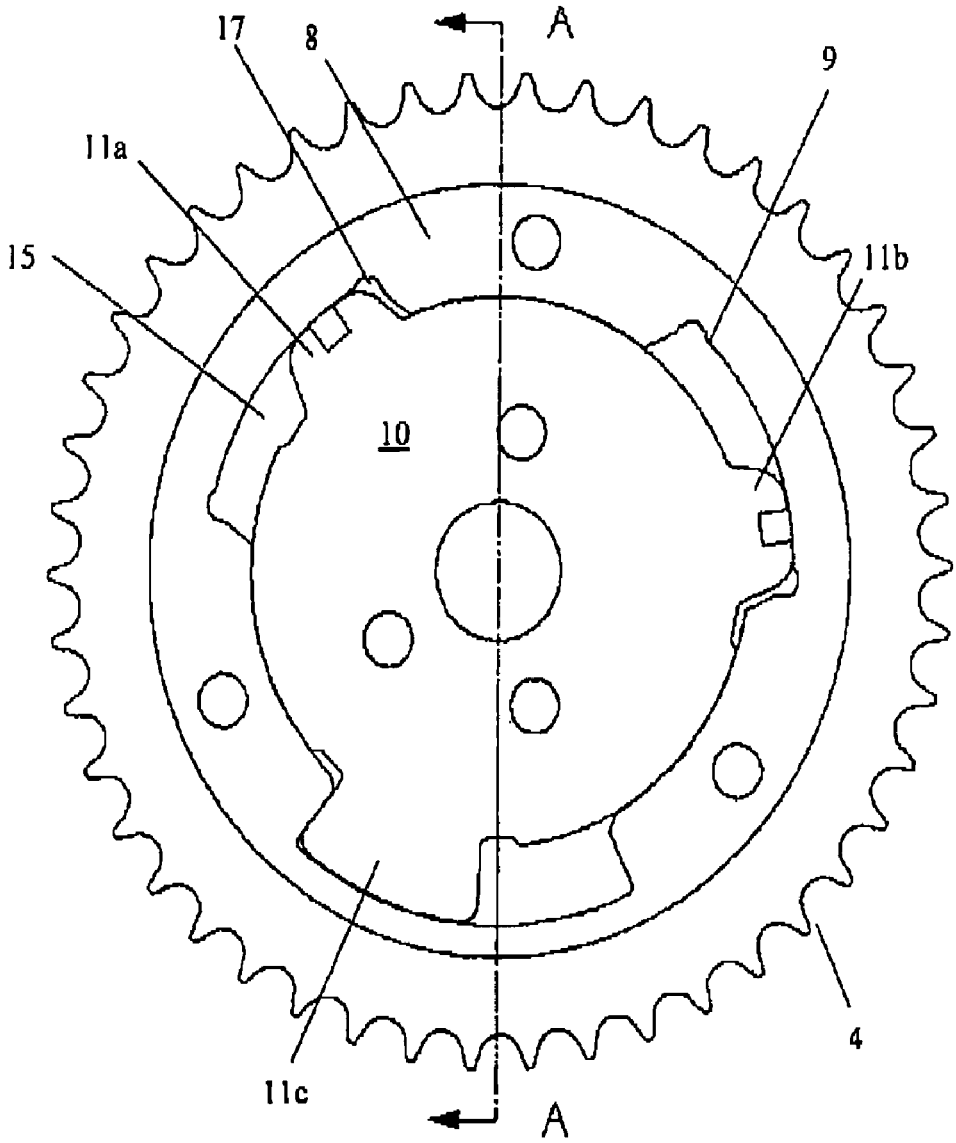
FIG. 4 shows a schematic of a second embodiment of variable cam timing phaser with concentric cams on one camshaft.
Figure 5:
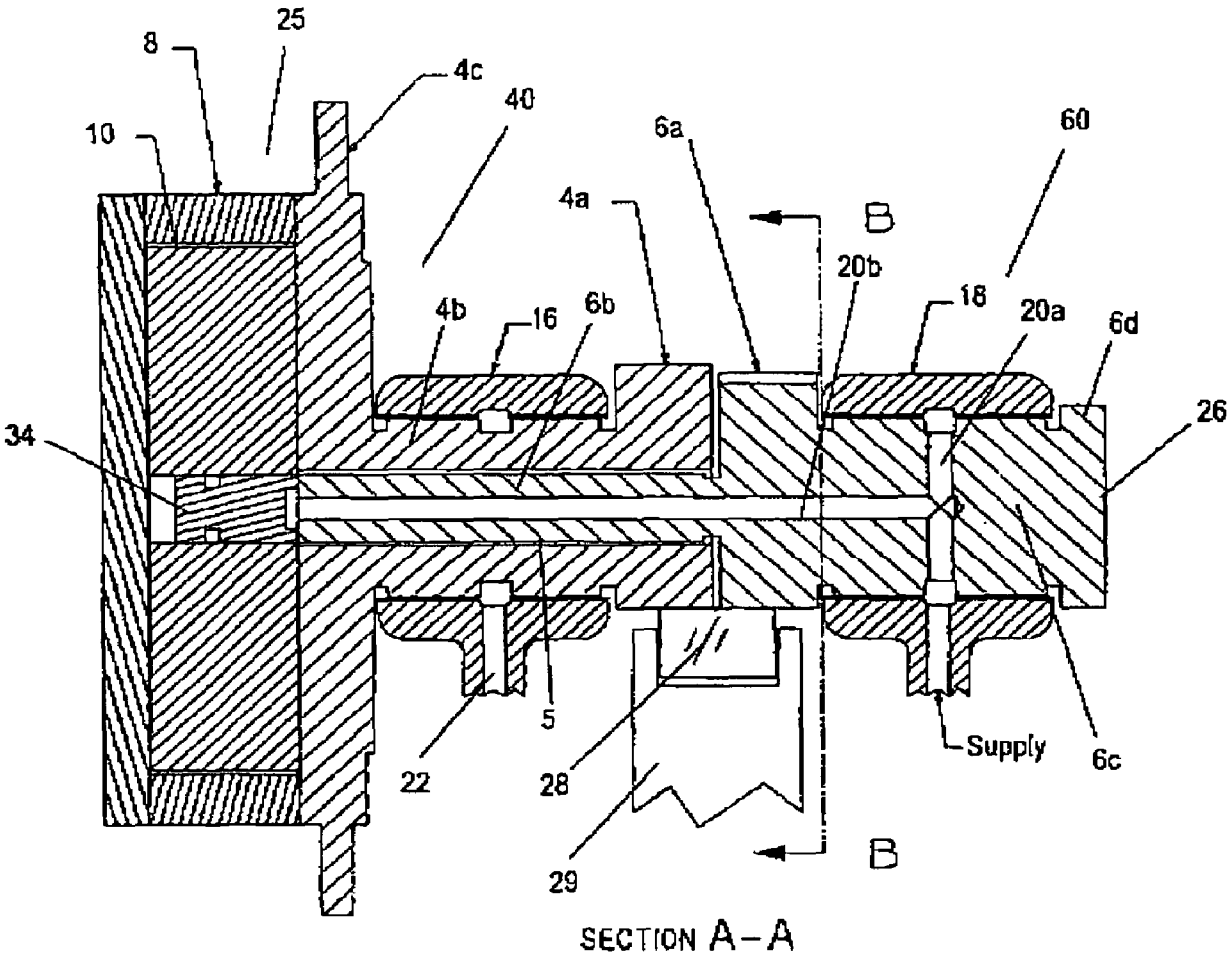
FIG. 5 shows a section of FIG. 4 along line A-A.
Figure 6:
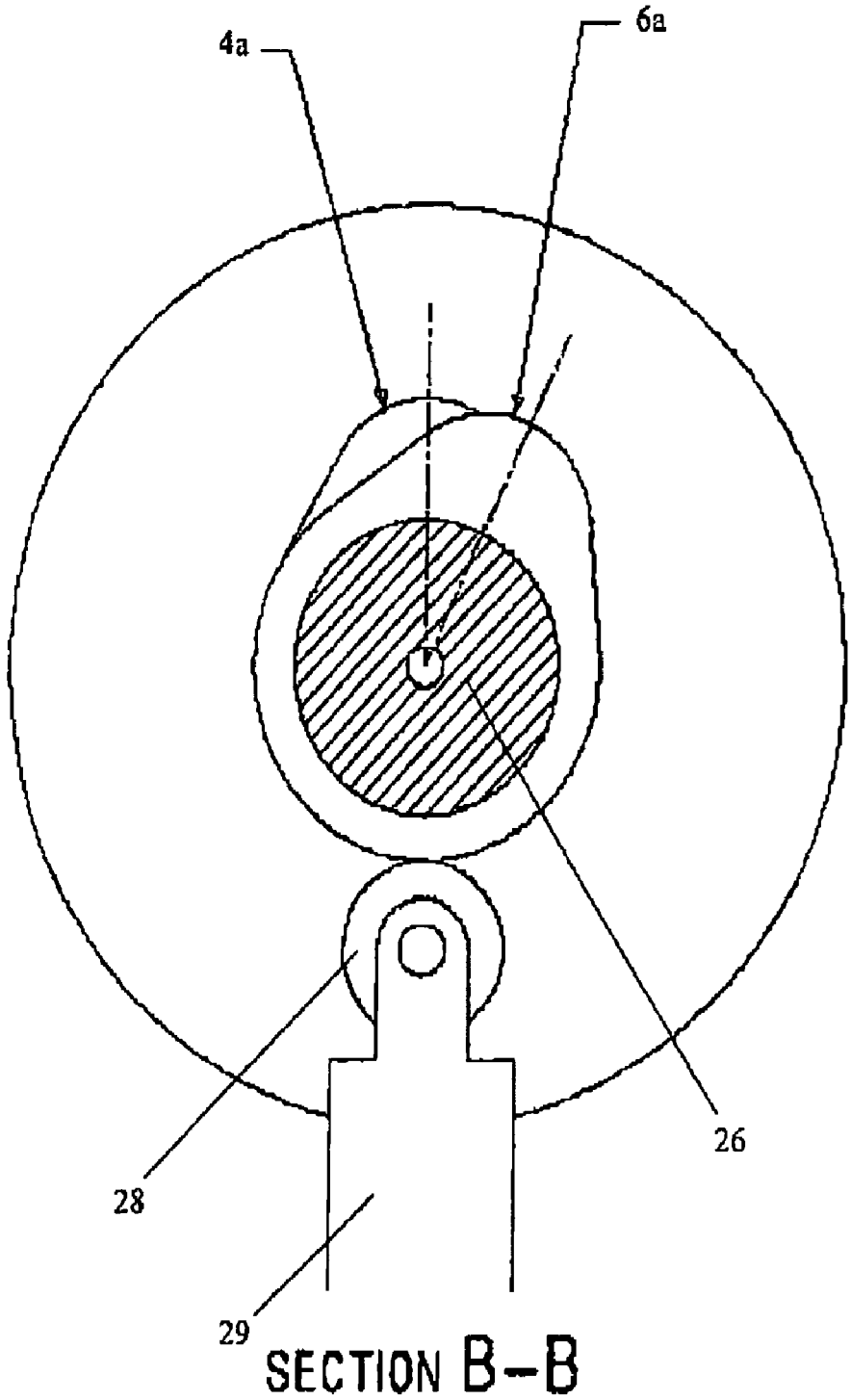
FIG. 6 shows a section of FIG. 5 along line B-B.

FIGS. 4 through 6 show a second embodiment of the present invention. An outside cam 4*a* is integrally attached to the portion 4*c* of housing 8 forming the outer circumference of the housing for accepting drive force through a middle portion 4*b*, forming a first camshaft piece or outer camshaft piece 40. The middle portion 4*b* is surrounded by a first bearing 16. A central hollow 5 extends the entire length of the first camshaft piece 40, through the outside cam 4*a*, the middle portion 4*b*, and through the portion 4*c* of the housing 8 forming the outer circumference for accepting drive force. The portion 4*c* for accepting drive force seals the end of the phaser 25 and is fixedly attached to the housing 8. Adjacent to the outside cam 4*a* is an inner cam 6*a*. By having the inside and outside cams 4*a*, 6*a* inline next to each other, the roller 28 of the lifter 29 is able to ride on both lobes of the cams 4*a*, 6*a* at the same time. The inner cam 6*a* is integral with an inner tube portion 6*b* on one end that is received within the hollow 5 of the first camshaft piece 40 and is connected to the rotor 10 of the phaser coaxially located within the housing 8. The rotor 10 has a plurality of vanes 11*a*, 11*b*, 11*c* that separate chambers 9 formed between the housing 8 and the rotor 10 into advance chambers and retard chambers 15, 17. Opposite the inner tube portion 6*b*, on the other side of the inner cam 6*a* is a shaft portion 6*c* with an end piece 6*d* larger than the diameter of the first camshaft piece 40, the inner tube portion 6*b* and shaft portion 6*c*. The end piece 6*d* on the shaft portion 6*c* prevents the second camshaft piece 60 or inner camshaft piece including the inner cam 6*a*, the inner tube portion 6*b*, the shaft portion 6*c*, and the end piece 6*d*, from dislodging from the assembly. The shaft portion 6*b*, not including the end piece 6*d* is surrounded by a second bearing 18. A passage 20*b* is present along the length of the second camshaft piece or inner camshaft piece 60 to supply fluid from the inlet line 20*a* to the phaser. Passage 22 supplies oil to feed the bearing. The passage 20*b* provides fluid to the advance and retard chambers 15, 17 through a control valve 14 with in a bore 3 in the rotor 10. The control valve 14 controls the flow of fluid to the advance and retard chambers 15, 17 and the position of the rotor 10 relative to the housing 8. While not shown in the cross-section, a vent is present at the back of the control valve. The position of the control valve 14 is influenced by a regulated pressure control system (RPCS), which is disclosed in PCT/US2006/017259 filed May 2, 2006 and is hereby incorporated by reference.

As the rotor 10 moves, the inner cam 6*a* is phased relative to the outer camshaft piece 40, allowing duration of the valve event to be increased or decreased. By varying the duration of the valve event, the valve opening or closing ramps are varied. Since the cam bearings 16, 18 in the head are used to support the inner camshaft piece 40 and the outer camshaft piece 60, no bearings are required in the outer camshaft piece 60 to support the inner camshaft piece 40. By not having any bearings internal to the outer cam 4*a*, the base circle runout is dictated by the cam bearing clearance in the head.

Figure 7:
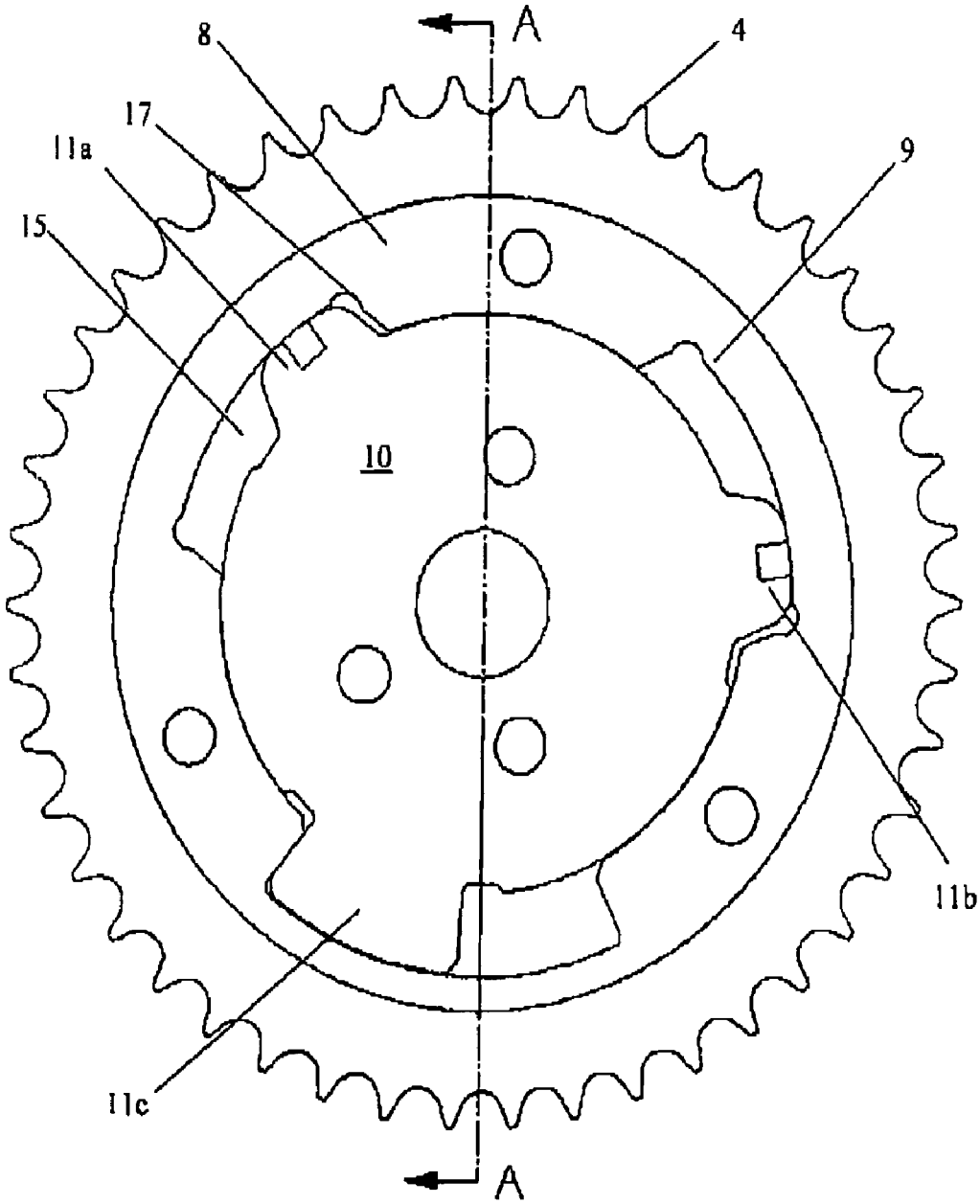
FIG. 7 shows a schematic of a third embodiment of dual variable cam timing phasers with concentric cams on one camshaft.
Figure 8:
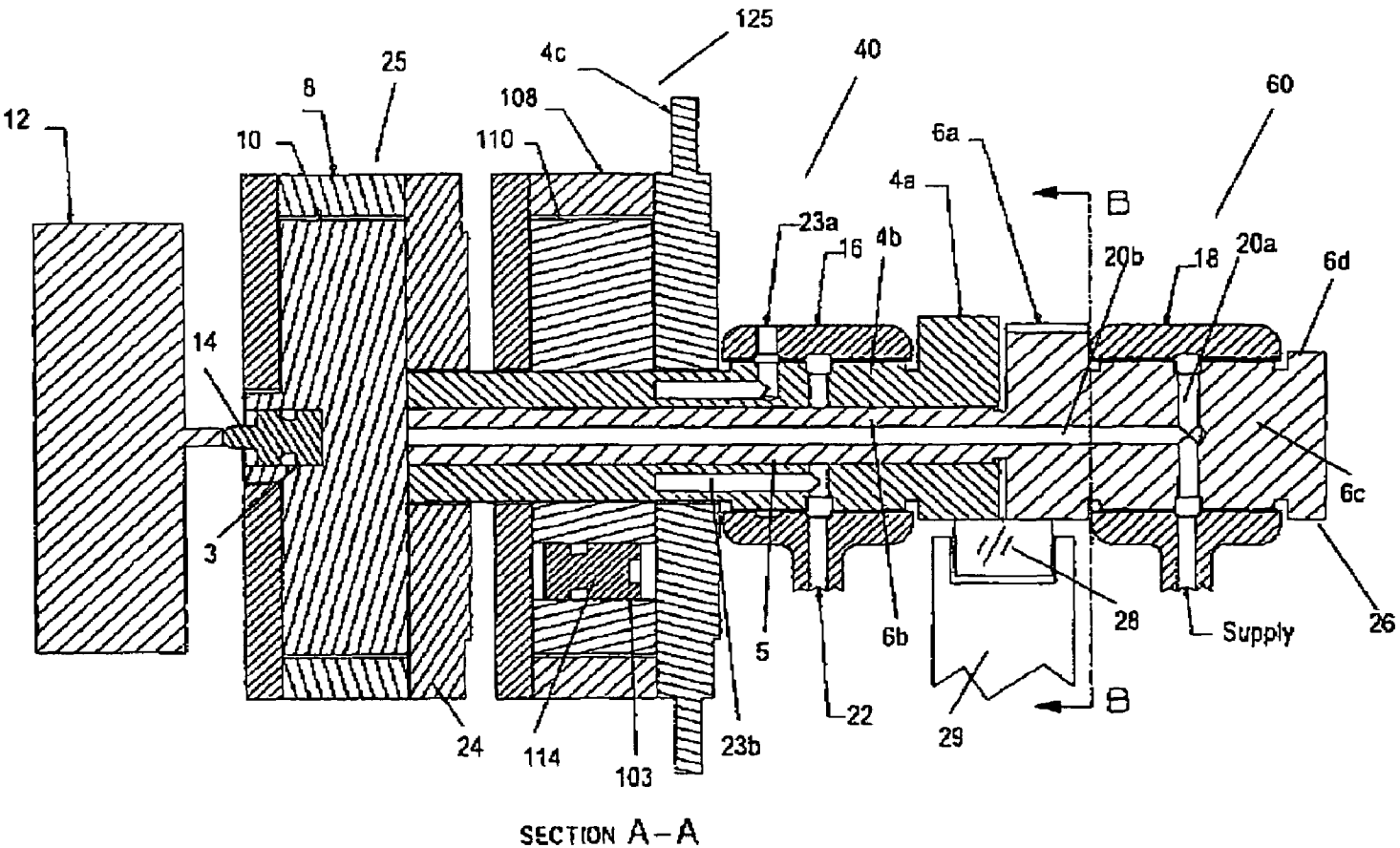
FIG. 8 shows a section of FIG. 7 along line A-A.
Figure 9:
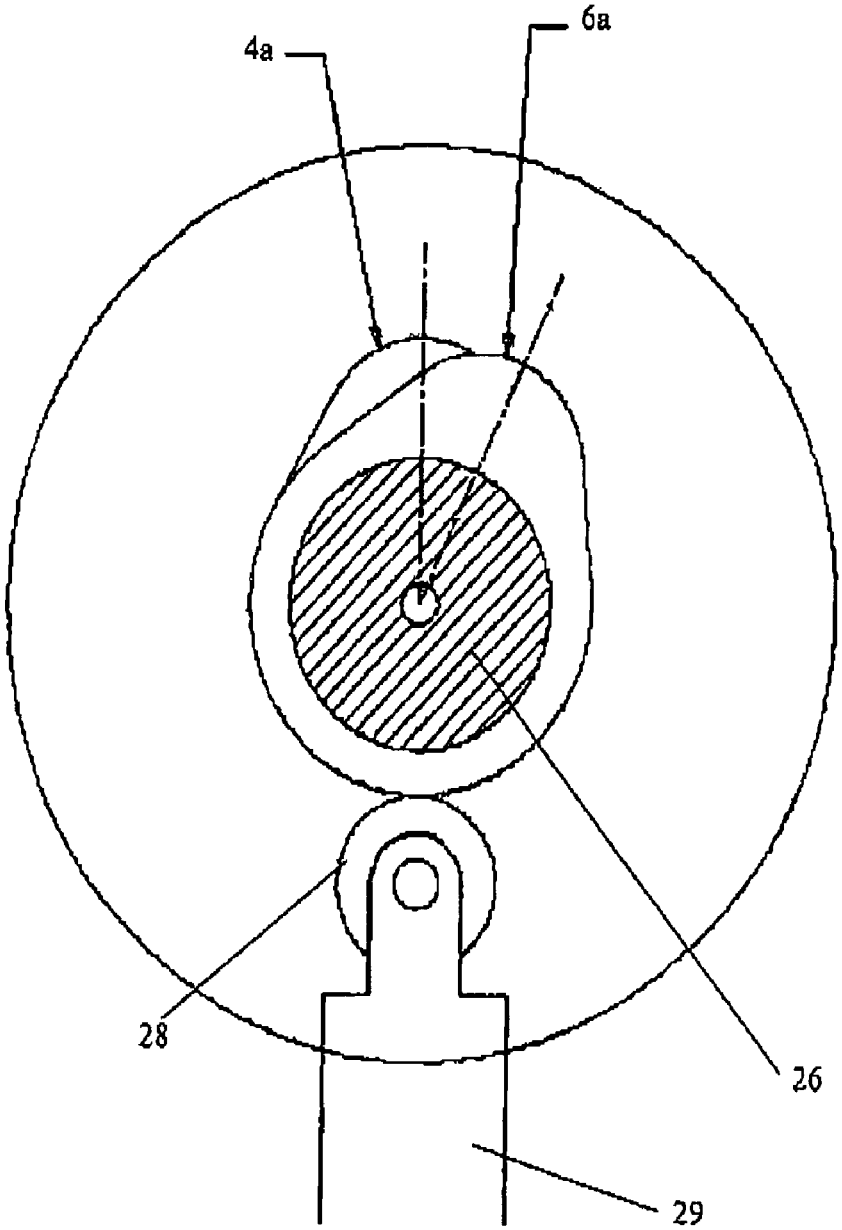
FIG. 9 shows a section of FIG. 8 along line B-B.

FIGS. 7-9 show a third embodiment of the present invention. In this embodiment two phasers 25, 125 are used. Each of the phasers 25, 125 includes a rotor 10, 1110 with one or more vanes 11*a*, 11*b*, 11*c* (not shown in second phaser 125) mounted to the end of the inner camshaft piece 60, surrounded by a housing 8, 108 with vane chambers 9 into which vanes fit 11*a*, 11*b*, 11*c*, dividing the vane chambers 9 into advance and retard chambers 15, 17. One of the phasers 125 has a housing 108 with an outer circumference 4*c* for accepting drive force from a chain, belt, or gear, from the crankshaft or from another camshaft in a multiple cam engine.

Both the inner and outer cams 6*a*, 4*a* have a phaser 125, 25 attached to them allowing both cams 6*a*, 4*a* to be phased relative to each other. The outside cam 4*a* is integrally attached to a middle tubular portion 4*b* that extends from the outside cam 4*a* through the second phaser 125 and through the end plate 24 of the first phaser 25, fixedly attaching to the end plate 24 of the first phaser 25. Extending through the outside cam 4*a* and middle tubular portion 4*b* is a central hollow 5. A portion of the middle tubular portion 4*b* is surrounded by a first bearing 16. Through the first bearing 16 multiple passages 23*a*, 23*b*, 22 are present leading from supply, providing fluid to the control valve 114 received within a bore 103 in the rotor 110 of the second phaser 125. Line 22 provides fluid to the bearing.

Adjacent to the outside cam 4*a* is an inner cam 6*a*. By having the inside and outside cams 6*a*, 4*a* inline next to each other, the roller 28 of the lifter 29 is able to ride on both lobes of the cams at the same time. The inner cam 6*a* is integral with an inner tube portion 6*b* on one end that is received within the hollow 5 of the first camshaft piece 60 and passes through the second phaser 125 and is connected to the rotor 8 coaxially located within the housing 8 of the first phaser 25. Opposite the inner tube portion 6*b*, on the other side of the inner cam 6*a* is a shaft portion 6*c* with an end piece 6*d* larger than the diameter of the first camshaft piece 60, the inner tube portion 6*b*, and the shaft portion 6*c*. The end piece 6*d* on the shaft portion 6*c* prevents the second camshaft piece or inner camshaft piece 40 comprised of the inner cam 6*a*, the inner tube portion 6*b*, the shaft portion 6*c*, and the end piece 6*d* from dislodging from the assembly. The shaft portion 6*c*, not including the end piece 6*d* is surrounded by the second bearing 18. A passage 20*b* is present along the length of the second camshaft piece or the inner camshaft piece 40 to supply fluid from an inlet line 20*a* to the first phaser 25. The passages 20*a*, 20*b* provide fluid to the advance and retard chambers 15, 17 through a control valve 14 within a bore 3 in the rotor 10 of the first phaser 25. The control valve 14 controls the flow of fluid to the advance and retard chambers 15, 17 and the position of the rotor 8 relative to the housing 8. The position of the control valve 14 in the first phaser 25 is influenced by an actuator 12. The actuator 12 shown in FIG. 8 may be a variable force solenoid, a motor, or an on/off solenoid.

By using two phasers 25, 125, one attached to each cam 6*a*, 4*a*, both the opening and closing ramps of the valve event can be adjusted simultaneously while increasing or decreasing the duration of the valve event. In this embodiment, the valve event itself may also be phased. Furthermore, by adding a phaser 125 to the outer cam 4*a*, the entire valve event can be advanced or retarded from its base timing position. Valve events may also be added as necessary. Using two phasers 25, 125 also allows both cam lobes to be phased far enough apart form each other, allowing two valve events for one cylinder within a 360 degree revolution of both camshaft pieces, allowing strategies such as internal EGR and engine braking to be used.

The second phaser of the embodiment shown in FIGS. 7 through 9 may be actuated using a regulated pressure control system (RPCS) as disclosed in PCT/US2006/017259, filed in May 2, 2006, which is herein incorporated by reference.

In all of the above embodiments, the first camshaft piece or the outer camshaft piece 40 and the second camshaft piece or the inner camshaft piece 60 together form the camshaft assembly 26.

The phasers in any of the above embodiments may be cam torque actuated phasers as disclosed in U.S. Pat. No. 5,107,804 issued Apr. 28, 1992, entitled "VARIABLE CAMSHAFT TIMING FOR INTERNAL COMBUSTION ENGINE" and is herein incorporated by reference, or hybrid as disclosed in a patent application Ser. No. 11/286,483 entitled, "CTA PHASER WITH PROPORTIONAL OIL PRESSURE FOR ACTUATION AT ENGINE CONDITION WITH LOW CAM TORSIONALS," filed on Nov. 23, 2005 and hereby incorporated by reference, torsion assist phasers as disclosed in U.S. Pat. No. 6,883,481, issued Apr. 26, 2005, entitled "TORSIONAL ASSISTED MULTI-POSITION CAM INDEXER HAVING CONTROLS LOCATED IN ROTOR" with a single check valve TA, and is herein incorporated by reference and/or U.S. Pat. No. 6,763,791, issued Jul. 20, 2004, entitled "CAM PHASER FOR ENGINES HAVING TWO CHECK VALVES IN ROTOR BETWEEN CHAMBERS AND SPOOL VALVE" which discloses two check valve TA, and is herein incorporated by reference, or oil pressure actuated phasers.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An assembly for an internal combustion engine comprising:

a) at least one phaser comprising:

i) a housing with an outer circumference for accepting drive force;

ii) a rotor coaxially located within the housing, the housing and the rotor defining at least one vane separating a chamber in the housing into advance and retard chambers, the vane being capable of rotation to shift the relative angular position of the housing and the rotor; and iii) a control valve received within a bore in the rotor for directing fluid to the chambers;

b) a camshaft assembly comprising:

i) an outer camshaft piece having: an outer cam integrally attached to the outer circumference of the housing through a middle portion; the outside cam, the middle portion, and the outer circumference of the housing for accepting driving force defining a hollow extending a length of the outer camshaft piece; and ii) an inner camshaft piece having: an inner cam adjacent to the outer cam, having a tube portion extending from a first side of the inner cam and received by the hollow defined by the outer camshaft piece, connecting the inner cam to the rotor of the phaser, and a shaft portion extending to an end portion from a second side of the inner cam; wherein a passage connected to an inlet line extends through the shaft portion, the inner cam, and the tube portion, directing fluid to the control valve of the phaser;

wherein when the rotor of the phaser moves, the inner cam is phased relative to the outer cam, allowing duration of a valve event to be increased or decreased.

2. The assembly of claim 1, wherein the middle portion of the outside camshaft piece is surrounded by a first bearing and a portion of the shaft portion of the inner camshaft piece is surrounded by a second bearing.

3. The assembly of claim 2, wherein the first and second bearings are in a head of the engine and support the inner and outer camshaft pieces, such that no bearings are required in the outer camshaft piece to support the inner camshaft piece.

4. The assembly of claim 1, wherein the outer circumference of the housing for accepting drive force is fixedly attached to the housing and forms an end plate of the phaser.

5. The assembly of claim 1, wherein the outer cam and the outer camshaft piece are fixed.

6. The assembly of claim 1, wherein the end portion of the inner camshaft piece has a greater diameter than the shaft portion of the inner camshaft piece, the tube portion of the inner camshaft piece, and the outer camshaft piece, preventing the inner camshaft piece from falling out of the outer camshaft piece.

7. The assembly of claim 1, wherein the inner cam and the outer cam are inline next to each other, such that a roller of a lifter rides on both the inner cam and outer cam at the same time.

8. The assembly of claim 1, wherein the phaser further comprises an actuator for positioning the control valve.

9. The assembly of claim 8, wherein the actuator is a variable force solenoid; a motor, an on/off solenoid, or a differential pressure control system.

10. The assembly of claim 1, wherein the control valve is actuated by a regulated pressure control system.

11. The assembly of claim 1, wherein the phaser is cam torque actuated, oil pressure actuated, hybrid, or torsion assist.

12. An assembly for an internal combustion engine comprising:

a) a first phaser comprising:

i) a first housing;

ii) a first rotor coaxially located within the first housing, the first housing and the first rotor defining at least one vane separating a chamber in the housing into advance and retard chambers, the vane being capable of rotation to shift the relative angular position of the first housing and the first rotor; and iii) a first control valve received within a bore in the first rotor for directing fluid to the chambers;

b) a second phaser comprising:

i) a second housing an outer circumference for accepting drive force;

ii) a second rotor coaxially located within the second housing, the second housing and the second rotor defining at least one vane separating a chamber in the second housing into advance and retard chambers, the vane being capable of rotation to shift the relative angular position of the second housing and the second rotor; and iii) a second control valve received within a bore in the second rotor for directing fluid to the chambers;

c) a camshaft assembly comprising:

i) an outer camshaft piece having: an outer cam integrally attached to the outer circumference of the second housing of the second phaser and the first housing of the first phaser through a middle portion, the outer cam, the middle portion defining a hollow extending a length of the outer camshaft piece; and ii) an inner camshaft piece having: an inner cam adjacent to the outer cam, having a tube portion extending from a first side of the inner cam and received by the hollow defined by the outer camshaft piece, connecting the inner cam to the first rotor of the first phaser, and a shaft portion extending to an end portion from a second side of the inner cam, wherein a passage connected to an inlet line extends through the shaft portion, the inner cam, the tube portion, and the second phaser, directing fluid to the first control valve of the first phaser;

wherein when the first rotor of the first phaser moves, the inner cam is phased relative to the outer cam, allowing phasing, duration, opening, and closing of a valve event to be increased or decreased.

13. The assembly of claim 12, wherein a portion of the middle portion of the outside camshaft piece is surrounded by a first bearing and a portion of the shaft portion of the inner camshaft piece is surrounded by a second bearing.

14. The assembly of claim 13, wherein the first and second bearings are in a head of the engine and support the inner and outer camshaft pieces, such that no bearings are required in the outer camshaft piece to support the inner camshaft piece.

15. The assembly of claim 12, wherein the outer circumference of the housing for accepting drive force is fixedly attached to the second housing and forms an end plate of the second phaser.

16. The assembly of claim 12, wherein the outer cam and the outer camshaft piece are fixed.

17. The assembly of claim 12, wherein the end portion of the inner camshaft piece has a greater diameter than the shaft portion of the inner camshaft piece, the tube portion of the inner camshaft piece, and the outer camshaft piece, preventing the inner camshaft piece from falling out of the outer camshaft piece.

18. The assembly of claim 12, wherein the inner cam and the outer cam are inline next to each other, such that a roller of a lifter rides on both the inner cam and the outer cam at the same time.

19. The assembly of claim 12, wherein the first phaser further comprises an actuator for positioning the first control valve.

20. The assembly of claim 19, wherein the actuator is a variable force solenoid, a motor, an on/off solenoid, or a differential pressure control system.

21. The assembly of claim 12, wherein the second control valve of the second phaser is actuated using a regulated pressure control system.

22. The assembly of claim 12, wherein the first phaser is cam torque actuated, oil pressure actuated, torsion assist, or hybrid.

23. The assembly of claim 12, wherein the second phaser is cam torque actuated, oil pressure actuated, torsion assist, or hybrid.

* * * * *